US005918737A

United States Patent [19]

Kwon

[11] Patent Number: 5,918,737

[45] Date of Patent: Jul. 6, 1999

[54] DUAL GOLF BAG

[76] Inventor: Young-Joon Kwon, 40 Bephany Dr., Commack, N.Y. 11725

[21] Appl. No.: 08/916,367

[22] Filed: Aug. 22, 1997

[51] Int. Cl.[6] ..... A63B 55/00

[52] U.S. Cl. ..... 206/315.3; 206/315.5; 206/315.6; 206/315.8

[58] Field of Search ..... 406/315.3, 315.5, 406/315.6, 315.8

[56] References Cited

U.S. PATENT DOCUMENTS

| | | | |
|---|---|---|---|
| 4,881,638 | 11/1989 | Cho | 206/315.5 X |
| 5,074,576 | 12/1991 | Finlay | 206/315.6 X |
| 5,188,243 | 2/1993 | Ruiz | 206/315.3 X |
| 5,358,109 | 10/1994 | Nichols | 206/315.3 |
| 5,573,112 | 11/1996 | Kim | 206/315.3 X |
| 5,613,603 | 3/1997 | Joh | 206/315.3 X |
| 5,624,028 | 4/1997 | Shin et al. | 206/315.3 X |
| 5,632,496 | 5/1997 | Nelson | 206/315.3 X |

*Primary Examiner*—Gary E. Elkins
*Assistant Examiner*—Tri M. Mai
*Attorney, Agent, or Firm*—Smith Patent Office

[57] ABSTRACT

The present invention relates to a dual golf bag, the bag comprises: a cylindrical mother bag including a mother top having a plurality of openings along a periphery thereof, a mother bottom having a plurality of openings corresponding to those of the mother top, a plurality of fabric bands arranged between the mother top and the mother bottom to form partitions thereamong and an outer cover attached outside of the mother top and the mother bottom; and a kid bag including a kid top having a plurality of openings, a kid bottom having a plurality of openings corresponding to those of the kid top, a plurality of fabric bands disposed between the kid top and the kid bottom to form partitions thereamong and an outer cover attached outside of the kid top and the kid bottom.

6 Claims, 8 Drawing Sheets

DUAL GOLF BAG

BACKGROUND OF THE INVENTION

1. Field of the Invention

The present invention relates to a golf bag, and more particularly to a dual golf bag of an organizer type for organizable storage and convenient carriage of golf clubs and for compact transportation of the bag.

2. Description of the Related Art

Generally, a golf bag is used to carry to a golf course a set of golf clubs including 9 iron pieces, 3 wood pieces and a putter along the holes during the game. The golf bag usually has one opening or a plurality of openings partitioned for selectively keeping the iron pieces or the wood pieces organized style.

Meanwhile, a golf course can be classified into an 18-hole course and a 9-hole course and the number of golf clubs used by a golfer is varied according to the golf course.

Furthermore, a fewer number of golf clubs are needed when a golfer goes to an exercise golf link instead of going to a green, so it would be convenient to have a golf bag of variable construction developed according to the need of the golfer.

However, there is a problem in the conventional golf bag in that it is constructed of a unitary integrated form, to thereby force a golfer to carry the entire golf bag regardless of the number of golf clubs required.

There is another problem in that a golf bag for a full set of golf clubs has to be carried even when a fewer golf clubs are used, so that a heavy golf bag presents a weight burden to a golfer.

SUMMARY OF THE INVENTION

Accordingly, the present invention is disclosed to solve the afore-mentioned problem and it is an object of the present invention to provide a dual golf bag adjustable in size thereof by which a full set or part of the golf clubs can be transported according to the need of the golfer.

In accordance with one object of the present invention, there is provided a dual golf bag that is adjustable in size thereof according to the need of the golfer by way of separation of a kid bag for independent use, the dual golf bag comprising:

a cylindrical mother bag including a mother top having a central void and a plurality of openings arranged along outer periphery thereof, a mother bottom, a plurality of fabric bands disposed between the mother top and the mother bottom to form partitions thereamong and an outer cover attached outside of the mother top and the mother bottom; and a kid bag including a kid top having a plurality of openings, a kid bottom having a plurality of openings corresponding to those of the kid top, a plurality of fabric bands disposed between the kid top and the kid bottom to form partitions thereamong and an outer cover attached outside of the kid top and the kid bottom, wherein the kid bag is separable from the mother bag.

In accordance with another object of the present invention, there is provided a dual golf bag, wherein the mother top comprises:

a soft top arranged with a plurality of openings and screw holes;

a mold divider having a ring-shaped body and a plurality of wings extending radially from an external surface of the body; and a mold bottom accommodating the soft top therein and provided with a plurality of locking parts for coupling to the wings along an inner periphery thereof, and the mother bottom comprises:

a mold divider having a ring-shaped body and a plurality of wings radially extending from an external surface of the body; and a mold bottom accommodating the soft top therein and provided with a plurality of locking parts for coupling to the wings along an inner periphery thereof, and wherein the kid top comprises:

a soft top arranged with a plurality of openings and screw holes;

a mold divider formed with a plurality of grid panels;

a mold bottom accommodating the soft top therein and provided with a plurality of locking parts for coupling to the panels along an inner periphery thereof, and the kid bottom comprises:

a mold divider formed with a plurality of grid panels; and a mold bottom accommodating the soft top therein and provided with a plurality of locking parts for coupling to the panels along an inner periphery thereof.

In accordance with another object of the present invention, there is provided a dual golf bag, wherein each longitudinal end of the wings of the mold dividers of the mother bag is formed with a coupling slot, and the locking part at the mother top and at the mother bottom is provided with a locking hole and a detent for coupling to the coupling slot of the wing, whereas each longitudinal end of the panels of the mold dividers of the kid bag are formed with a coupling slot, and the locking part at the kid top and the kid bottom is provided with a locking hole and a detent for coupling to the coupling slot of the panel for easy assembly.

The present invention is still further arranged with rod stay tubes respectively at the mold top and the mold bottom of the mother bag and the kid bag to thereby allow a plurality of rods to be fixed therebetween for maintaining a shape of the golf bag, so that the golf bag can be adjusted to a smaller size by disassembling the rods for compact transportation.

There is an advantage in the dual golf bag according to the present invention, in that dual construction allowing a kid bag to be easily separable from and able to be assembled with a mother bag according to the golfer's necessity and, therefore, it provides convenience of carriage of a few of selected golf clubs.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENTS

Preferred embodiment of a dual golf bag according to the present invention will now be described in detail with reference to the accompanying drawings.

Figure 1:
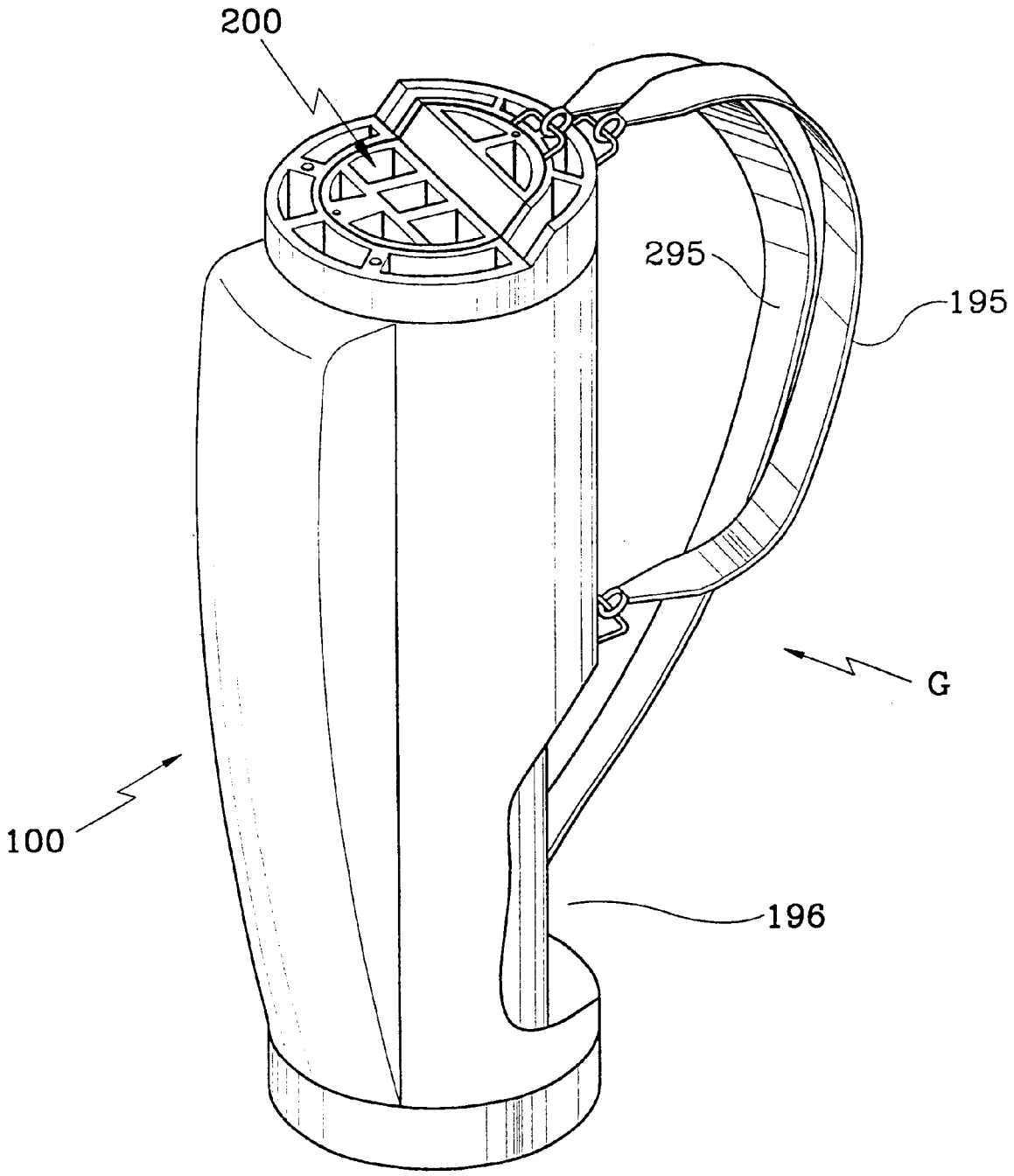
FIG. 1 is a perspective view of an assembled state of a dual golf bag according to the present invention.
Figure 2:
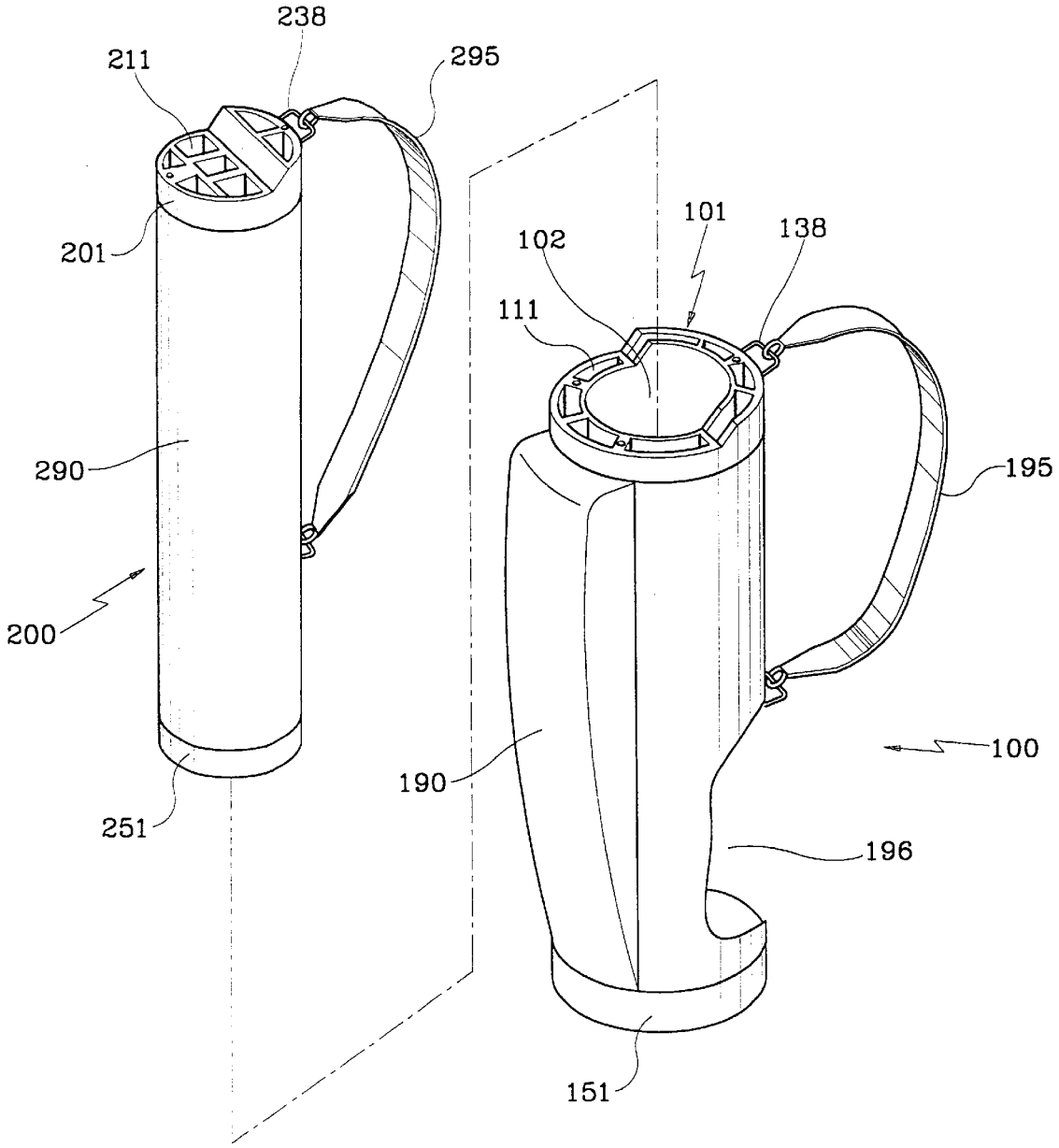
FIG. 2 is a perspective view of a separate state according to the present invention where a kid bag is separated from a mother bag.

FIG. 1 is a perspective view of an assembled state of a twin dual golf bag according to the present invention and FIG. 2 is a perspective view of a separate state according to the present invention where a kid bag is separated from a mother bag.

As illustrated in FIGS. 1 and 2, a dual golf bag according to the present invention includes a mother bag 100 forming an external appearance of a golf bag (G) and a kid bag 200 inserted into a central void 102 of the mother bag 100, and the kid bag 200 is separable from and can be assembled with the mother bag according to the intention of a golfer.

The mother bag 100 according to the present invention is made of a mother top 101 divided into a plurality of openings 111 and a mother bottom 151 with an outer cover 190 connecting therebetween.

The mother bag 100 is formed thereunder with a lateral opening 196 for hooking a strap 295 of the kid bag 200 therethrough.

The kid bag 200 is made of a kid top 201 divided to form a plurality of openings 211 and a kid bottom 251 with an outer cover 290 connecting therebetween, and is provided with a separate strap 295 for being separately carried away from the mother bag 100.

Furthermore, the s trap 295 of the kid bag 200 is constructed such that it can be easily separated from the lower part of the kid bag 200 for coupling to and separation from the mother bag 100.

Meanwhile although the drawings show eight (8) openings 111 for the mother bag 100 and seven (7) openings 211 for the kid bag 200, it is just for illustration and other variations are possible.

Figure 3:
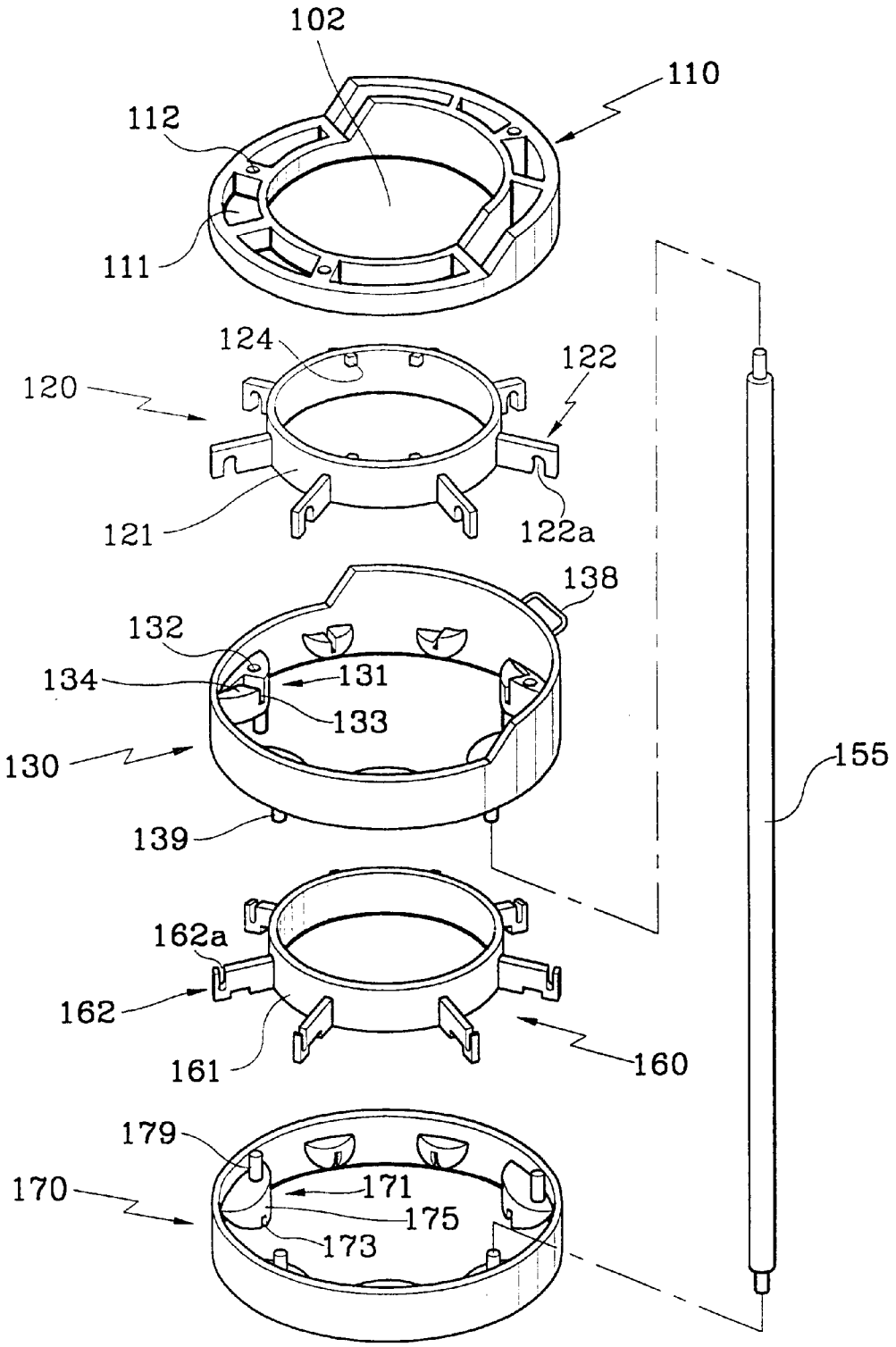
FIG. 3 is an exploded view of the principal parts of a mother bag according to the present invention.

FIG. 3 is a perspective view of principal parts of a mother bag according to the present invention, where the mother top 101 and the mother bottom 151 of the m other bag are separated.

The mother top 101 of the mother bag 100 for securing an upper end of the outer cover 190 is made of a soft top 110, a mold divider 120 and a mold top 130, whereas the mother bottom 151 is composed of a mold divider 160 and a mold bottom 170.

First of all, the construction of the mother top 101 is described. The mother top 101 is a ring-shaped member having a central void 102 through which the kid bag 200 is inserted. The soft top 110 forming an upper end of the mother bag 100 is formed with a plurality of openings 111 for storing a plurality of golf clubs along a periphery thereof, whereas a plurality of screw holes 112 for securing the soft top 110 to the mold top 130 during assembly of the mother top 101 are pierced therethrough. It is advisable that the soft top 110 is made of a material which is soft but not easily tearable.

Meanwhile, the mold divider 120 disposed between the soft top 110 and the mold top 130 is radially formed with a plurality of partitioning wings along a periphery of a ring-shaped frame 121, and longitudinal end of each wing 122 is formed with a downwardly-opened coupling slot 122*a* to thereafter be coupled to the mold top 130 (to be described later).

The ring-shaped frame 121 of the mold divider 120 is formed at the inner surface thereof with two pairs of locking protruders 124 which face each other and they are used for separation from and coupling to the locking means 236 of the kid bag 200.

The number of wings 122 formed at the mold divider 120 corresponds to openings 111 of the soft top 110.

The mold top 130 is a member forming a lower end of the mother top 101 and is coupled to the soft top 110 by way of screws, and a plurality of locking parts 131 for mating with the mold divider 120 is formed along an inner periphery thereof.

The mold top 130 is formed at one side thereof with a strap ring 138 for hooking the strap 195.

Figure 4:
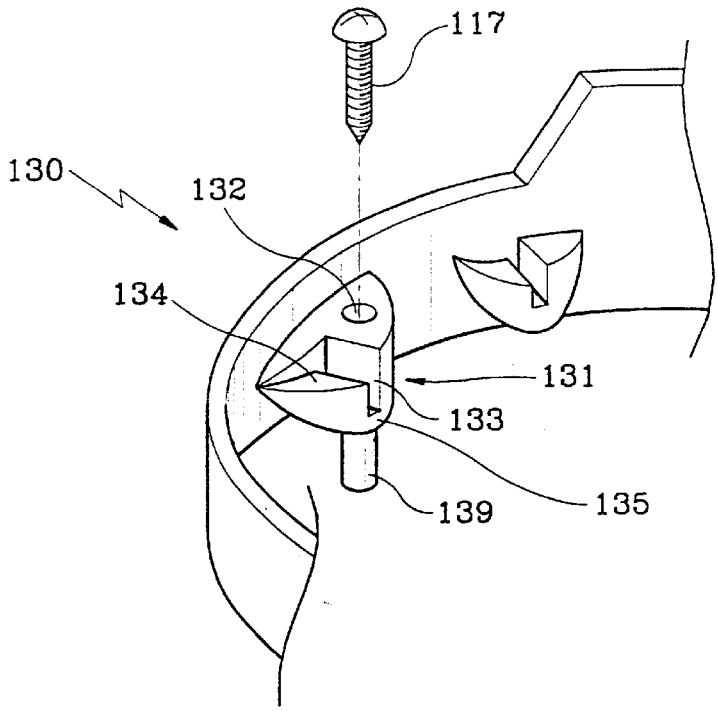
FIG. 4 is a partially enlarged perspective view of a mold top for a mother bag according to the present invention.
Figure 5:
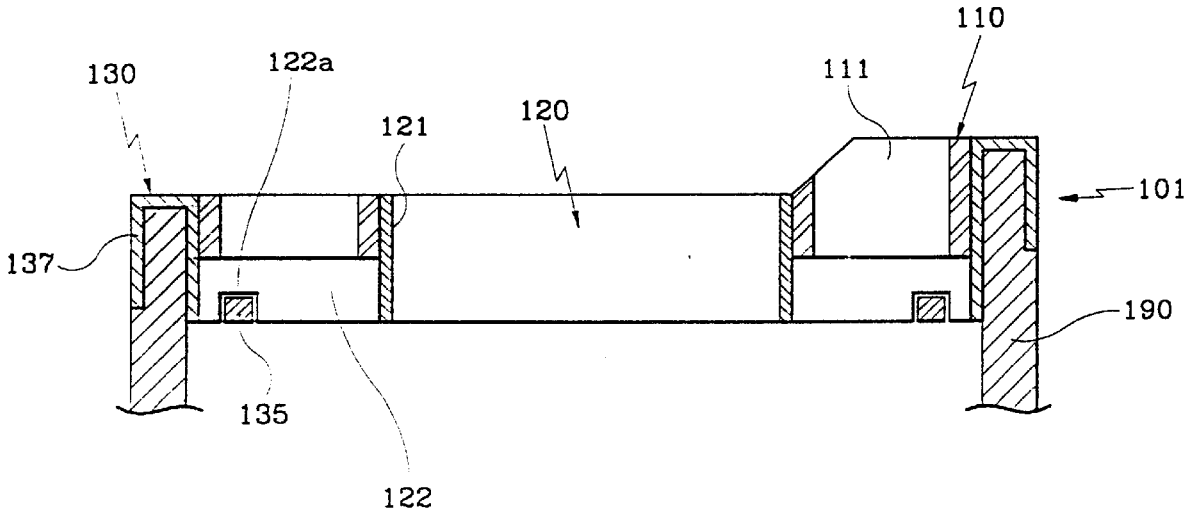
FIG. 5 is a sectional view for illustrating an assembled state of a mother top according to the present invention.

Some locking part 131, as illustrated in FIGS. 4 and 5, is disposed with a screw hole 132 for screwing the soft top 110, a locking hole 133 for supporting the wing 122 of the mold divider 120 therein and a slope 134 for guiding the wing 122 to the locking hole 133.

During the assembly of the mold divider 120, when a longitudinal end of the wing 122 is inserted into the locking hole 133 at the locking part 131, a detent 135 is mated with a coupling hole 122*a* formed at a tip end of the wing 122 of the mold divider 120 to thereby secure the wing 122 to the locking part 131.

Then, the soft top 110 is inserted into an upper end of the mold top 130, screw holes 112 and 132 are arranged, and screws 117 are screwed therein so that the mother top 101 is completely assembled.

The mold top 130 is formed along the periphery at an upper end with a ring-shaped outer cover support groove 137 extending downward from the outer surface of the mold top between which an upper end of the outer cover 190 is coupled.

Furthermore, under the locking part 131 of the mold top 130 is formed a rod stay tube 139 extending downward at a predetermined spacing along an inner periphery thereof to which a rod 155 (to be described later) is inserted.

The construction of the mother bottom 151 is described with reference to FIG. 3.

As illustrated, a mother bottom 151 is made of a bottom divider 160 and a mold bottom 170, where the bottom divider 160 includes, like the mold divider 120, a ring-shaped frame 161 and a plurality of wings 162 but it is different from the mold divider 120 in that coupling slot 162*a* formed at a tip end of the wing 162 is opened upward.

Meanwhile, the mold bottom 170 is a member having a bottom section thereof being closed and is formed with a plurality of locking parts 171 for securing a plurality of wings 162 of the mold divider 160 along an inner periphery thereof. The locking parts 171, though similar to the mold top 130, are formed reverse from the mold top 130, so that a coupling hole 173 is opened downward.

Accordingly, when the bottom divider 160 is to be secured to the mold bottom 170, the wing 162 of the bottom divider 160 is inserted into a space between the locking parts 171 of the mold bottom 170 and rotated so that the coupling slot 162*a* at each wing 162 is mated with the coupling hole 173 and the detent 175 of the locking part 171.

Furthermore, the locking part 171 at the mold bottom 170 is also formed with rod stay tubes 179, each at a predetermined spacing, like the mold bottom 130 of the mother top 101, but the rod stay tubes 179 are extended upward.

Figure 6:
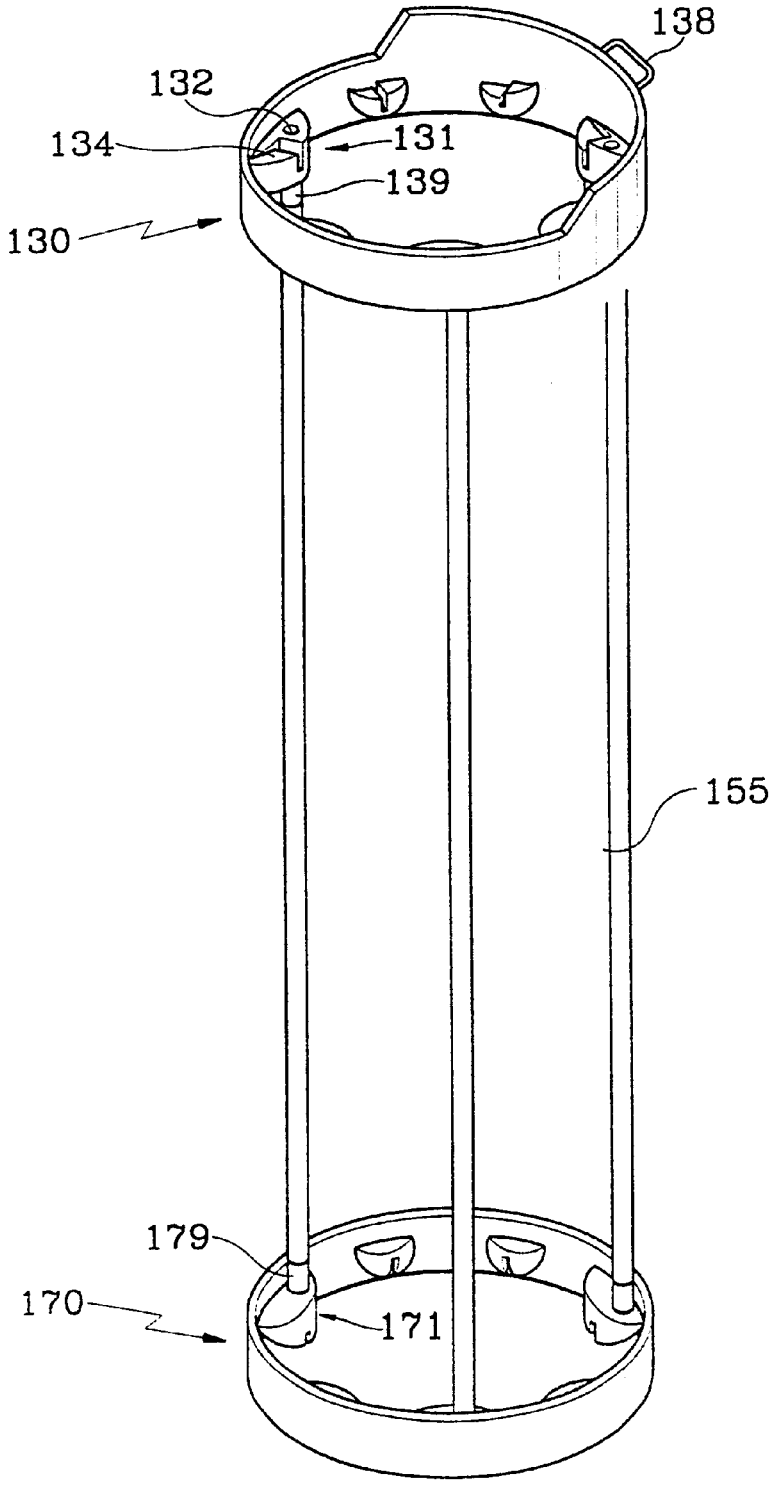
FIG. 6 is a perspective view for illustrating a connected state between a mold top and a mold bottom of a mother bag by way of a rod according to the present invention.

As illustrated in FIG. 6, the rod stay tubes 139 and 179 formed at the mold top 130 and the mold bottom 170 are disposed with rods 155 to thereby form an overall shape of the mother bag 100.

Figure 7:
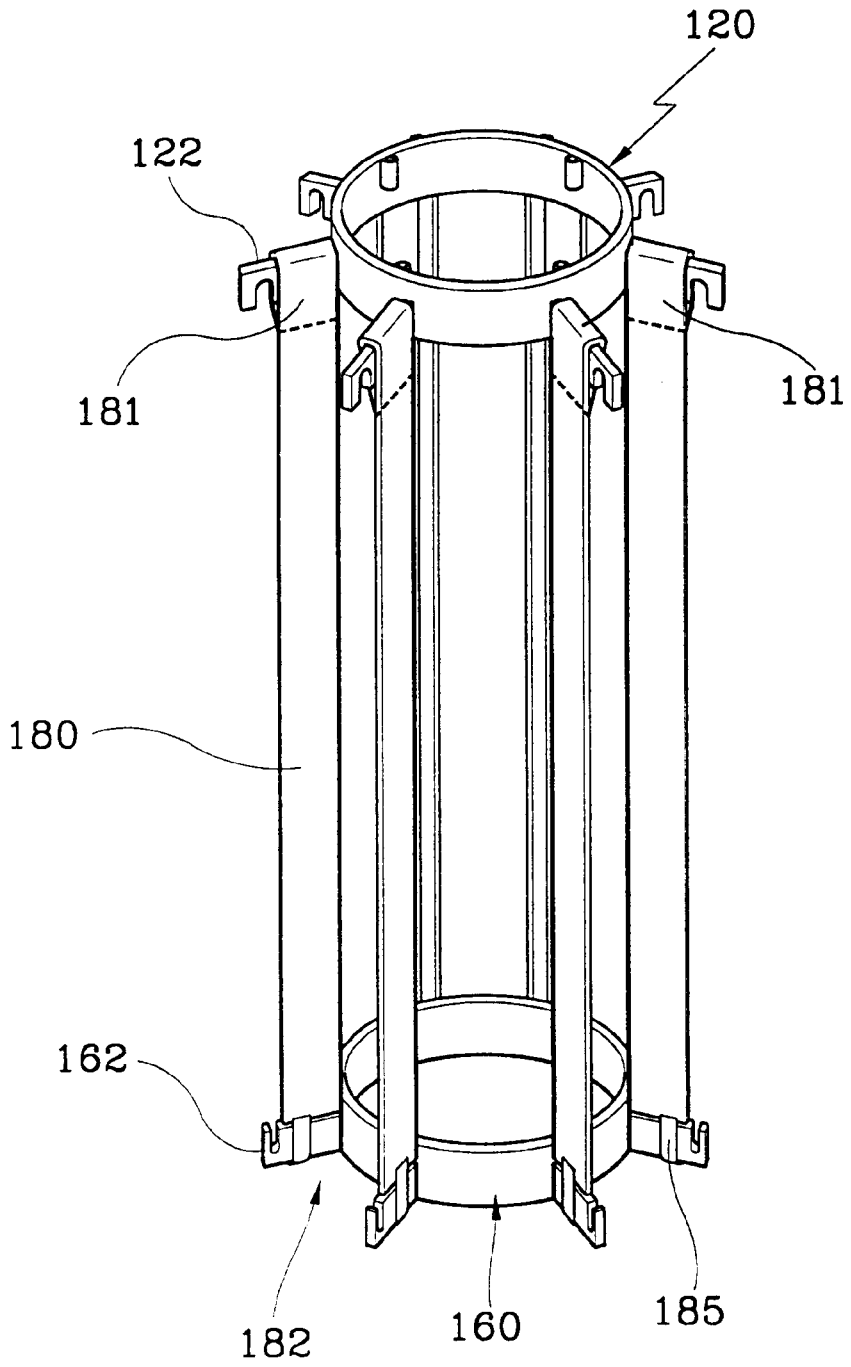
FIG. 7 is a perspective view for illustrating a state where fabric bands are attached to a pair of mold dividers of a mother bag according to the present invention.

Meanwhile, as shown in FIG. 7, the fabric band 180 is formed at an upper end thereof with an insertion part 181 by folding an upper end of the fabric band 180 for inserting the wing 122 of the top divider 120, and is provided at a bottom end thereof with a rubber fixture 185 to thereby be coupled to the wing 162 of the bottom divider 160.

The mold dividers 120 and 160 of the mother top 101 and the mother bottom 151 are inter-connected by a plurality of fabric bands 180, so that a plurality of partitions 182 corresponding to openings 111 of the soft top 110 are formed along a periphery of the mother bag 100.

The mother bag 100 according to the present invention is completed in assembly by disposition of fabric bands 180 at the mother top 101 and the mother bottom 151 with the rods 155 and the outer cover 190 coupled thereto.

Figure 8:
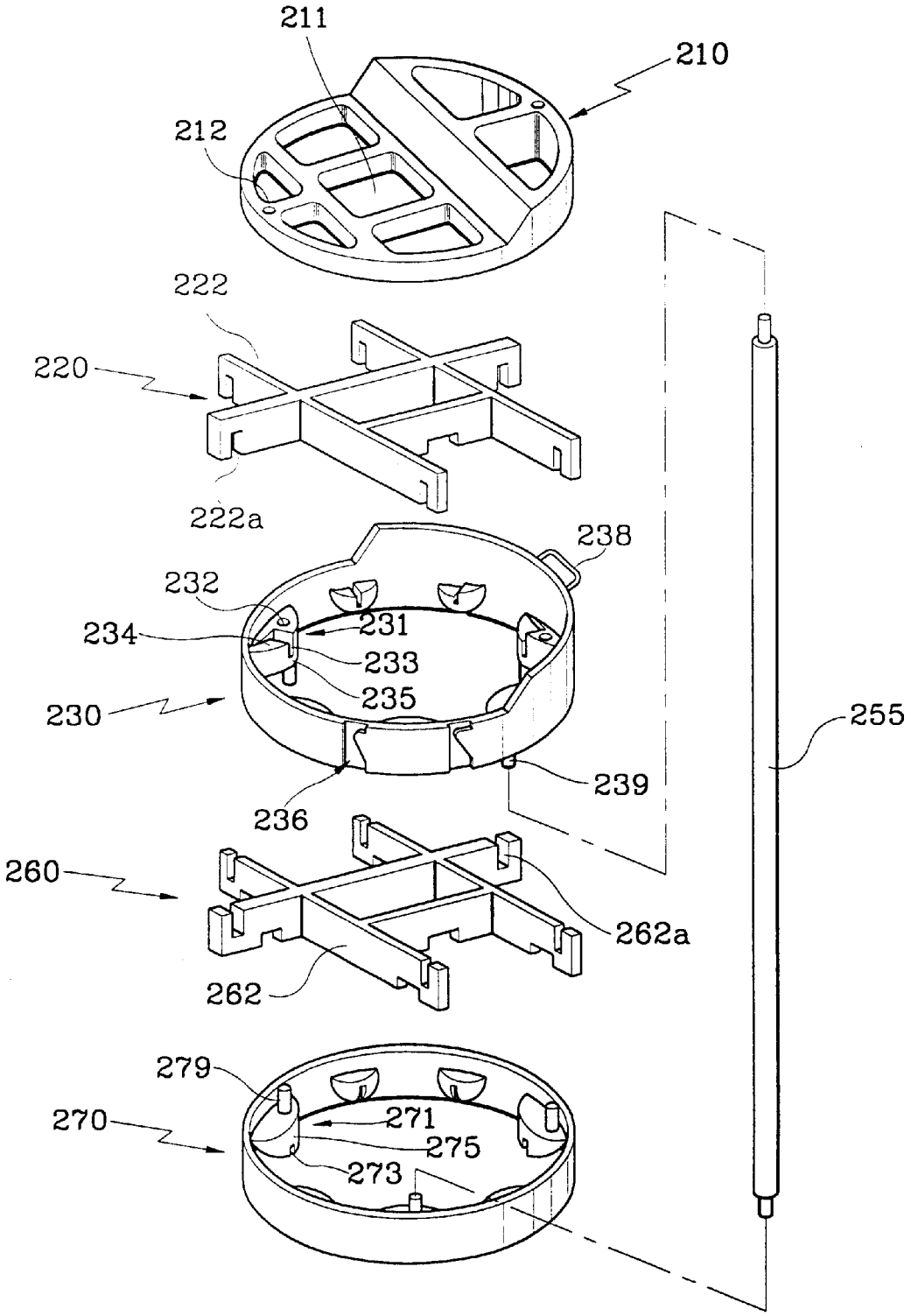
FIG. 8 is an exploded perspective view of principal parts of a kid bag according to the present invention.

Now, the kid bag 200 according to the present invention is described in construction thereof at FIGS. 2 and 8.

As illustrated in FIG. 2, the kid bag 200 according to the present invention is constructed similar to the mother bag 100. However, although the mother bag 100 is formed in a cylindrical shape having a void 102 to accommodate the kid bag 200, the kid bag 200 is formed as a filler so as to be inserted into the void 102 of the mother bag 100.

Furthermore, the kid bag 200 according to the present invention is constructed, like the mother bag 100, with an outer cover 290 between the kid top 201 and the kid bottom 251.

FIG. 8 is an exploded perspective view for illustrating the principal parts of the kid bag 200 according to the present invention.

The kid top 201 of the kid bag 200 for securing an upper end of the outer cover 290 is made of a soft top 210, a mold divider 220 and a mold top 230 while the kid bottom 251 consists of a mold divider 260 and a mold bottom 270.

The soft top 210 forming an upper surface of the kid bag 200 is provided with a plurality of openings 211 for storing and organizing a plurality of golf clubs. A plurality of screw holes 212 for assembling the kid top 201 with the mold top 230 are piercingly formed around the openings 211.

Meanwhile, the soft top 210 is advisable to be made of soft but not easily tearable material.

The mold divider 220 disposed between the soft top 210 and the mold top 230 is formed with a plurality of partitioning grid panels 222, and longitudinal end of each panel 222 is formed with downwardly opened coupling slot 222*a*, to thereafter be coupled to mold top 230 (to be described later).

The number and arrangement of the panels 222 at the mold divider 220 is decided corresponding to that of the openings 211 formed at the soft top 210.

The mold top 230 is a member for forming a bottom end of the kid top 201 and is coupled to the soft top 210 by way of screws, and is formed along an inner periphery thereof with a plurality of locking parts 231 for mating with the mold divider 220.

The locking part 231 of the mold top 230, like the mold top 130 of the mother top 101, includes screw holes 232, coupling holes 233 for fixing the panels 222 of the mold divider 220 and a slope 234 for guiding the panel 222 to the coupling holes 233. A detent is formed at an inner side of the coupling hole 233.

During assembly of the mold divider 220, when longitudinal end of the panel 222 is inserted into the locking hole 233 at the locking part 231, a detent 235 is mated with a coupling hole 222*a* formed at a tip end of the panel 222 of the mold divider 220, so that the panel 222 is secured tightly to the locking part 231. Then, the soft top 210 is inserted into an upper end of the mold top 230, where screw holes 212 and 232 are arranged for screw-coupling therebetween, which then completes assembly of the kid top 201.

Meanwhile, the mold top 230 is provided at one side thereof with a strap ring 238 for securing a strap 295 of the kid bag 200. Some locking part 231 of the mold top 230 is provided with a plurality of rod stay tubes 239 extended downward at a predetermined spacing along an inner periphery.

The mold top 230 is formed at an external peripheral surface thereof with a pair of locking means 236 disposed at a position corresponding to a pair of locking protruders 124 formed at an inner periphery of the ring-shaped frame 121 of the mold divider 120 at the mother top 101.

Figure 9:
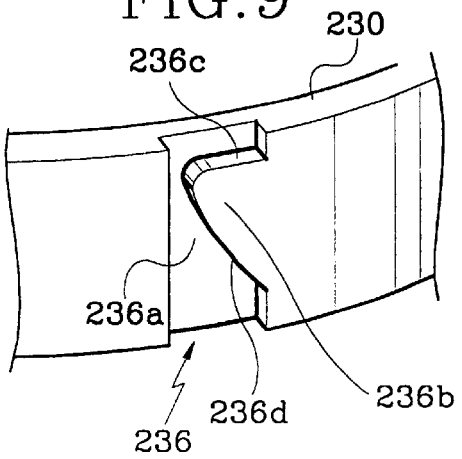
FIG. 9 is an enlarged perspective view of a locking part provided at a mold top of a kid bag according to the present invention.

The locking means 236 may be a latch 236*b* formed at one side of a cut-out 236*a* at the lateral and peripheral surface of the mold top 230, as illustrated in FIG. 9. The latch 236*b* has an upper surface 236*c* sloping upward toward the other side of the cut-out 236*a* and has a lower surface forming a sharp slope or an arched slop 236*d*.

Now back to FIG. 8, the construction of the kid bottom 251 will now be described.

As illustrated in FIG. 8, the kid bottom 251 is made of a bottom divider 260 and a mold bottom 270, just like the mother bottom 151, where the bottom divider 260 is formed with a plurality of grid panels 262, just like the mold divider 220 of the kid top 201. However, there is a difference from the mold divider 200 in that the coupling slot 262*a* formed at the tip end of the panel 262 is upwardly opened.

Meanwhile, the mold bottom 270 is a member closed at its bottom thereof and is formed with a plurality of locking parts 271 for securing a plurality of panels 220 of the mold divider 220 along an inner periphery thereof. The locking part 271 has a similar construction as that of the mold top 230 but in a reverse construction, so that coupling hole 273 is opened downward.

Accordingly, when the mold bottom 270 is coupled to the bottom divider 260, panel 262 of the bottom divider 260 is inserted into a spacing between the locking parts 271 and is rotated so that the coupling slot 262*a* at the panel 262 mates with the detent 275 of the locking part 271.

Furthermore, the locking part 271 of the mold bottom 270 is also formed with a rod stay tube 279 at a predetermined spacing just like the mold bottom 230 of the kid top 201.

Accordingly, like as the mother bag 100 as shown in FIG. 6, the rod stay tubes 239 and 279 at the mold top 230 and the mold bottom 270 are disposed with the plurality of rods 255 for maintaining a shape of the kid bag 200.

Figure 10:
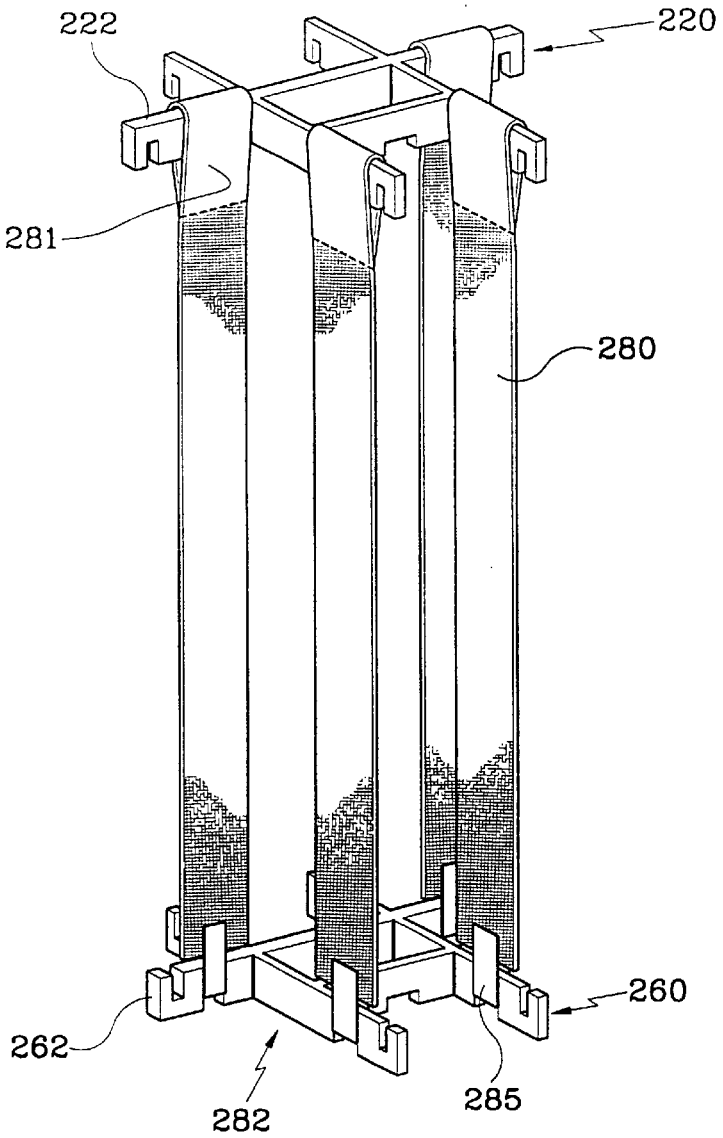
FIG. 10 is a perspective view for illustrating a state where fabric bands are disposed at a pair of mold dividers of a kid bag according to the present invention.

Furthermore, as illustrated in FIG. 10, the mold dividers 220 and 260 of the kid top 201 and the kid bottom 251 are interconnected by a plurality of fabric bands 280 to thereby form a plurality of partitions 282.

Meanwhile, the fabric band 280 is formed at an upper end thereof with an insertion part 281 for inserting the panel 222 of the top divider 220 by folding an upper end of the fabric band 280, and is provided at a lower end thereof with a rubber fixture 285 to be coupled to the panel 262 of the bottom divider 260.

Accordingly, the kid bag 200 according to the present invention is completed in assembly by disposing fabric bands 280 between the kid top 201 and the kid bottom 251 with rod 255 and outer cover 290 assembled thereto When the kid bag 200 thus constructed is inserted into the void 102 of the mother bag 100, the arched surface 236*d* of the locking means 236 formed at an outer surface of the mold top 230 at the kid bag 200 is engaged to two pairs of locking protruders 124 formed at an inner periphery of the ring-shaped frame 121 of the mold divider 120 at the mother bag 100, and then latch 236*b* formed at one side of the cut-out 236*a* is deformed, where locking protruder 124 passes through the cut-out 136*a* to allow the locking protruder 124 to be coupled to the locking means 236, so that the mother bag 100 and the kid bag 200 are assembled.

Accordingly, as illustrated in FIG. 1, the mother bag 100 and the kid bag 200 are used for storage and carriage of full sets of golf clubs when they are assembled, and as illustrated in FIG. 2, the kid bag 200 can be separated from the mother bag 100, whereby only the kid bag 200 can be used for storage and carriage of some portions of the golf clubs.

As apparent from the foregoing, there is an advantage in the dual golf bag in that a golfer can selectively use a fully assembled golf bag or a kid bag when he or she goes to the green or to a golf exercise link to thereby provide the golfer a reduced weight of a golf bag and convenience in carriage.

There is another advantage in that straps 195 and 295 are provided separately to the mother bag 100 and the kid bag 200, so that when full sets of golf clubs are carried in a fully assembled golf bag (G), two straps 195 and 295 are used for carriage to thereby provide further convenience for the golfer.

There is still another advantage in that volume of the dual bags 100 and 200 is collapsible by way of removing the rods 155 and 255 for maintaining the shape thereof to thereby provide further convenience in transportation of the golf bags with a reduced volume.

Although the invention has been described in detail with reference to its presently preferred embodiments, it will be understood by one of ordinary skill in the art that various modifications can be made, without departing from the spirit and scope of the invention. Accordingly, it is not intended that the invention be limited, except as by the appended claims.

What is claimed is:

1. A dual golf bag, the bag comprising:

a cylindrical mother bag including a mother top having a central void and a plurality of openings arranged along outer periphery thereof, a mother bottom located in a bottom portion of the mother bag, a plurality of fabric bands disposed between the mother top and the mother bottom to form partitions thereamong and a first outer cover attached outside of the mother top and the mother bottom; and a kid bag including a kid top having a plurality of openings, a kid bottom located in a bottom portion of the kid bag, a plurality of fabric bands disposed between the kid top and the kid bottom to form partitions thereamong and a second outer cover attached outside of the kid top and the kid bottom, wherein the kid bag is structured and arranged so as to be inserted into the mother bag through the central void in the mother top.

2. The dual golf bag as defined in claim 1, wherein said mother top comprises:

a first soft top having a plurality of openings and screw holes;

a first mold divider having a first ring-shaped body and a plurality of first wings extending radially from an external surface of the body; and a first mold top accommodating the first soft top therein and provided with a plurality of first locking parts for coupling to the first wings along an inner periphery thereof, and said mother bottom comprises:

a second mold divider having a second ring-shaped body and a plurality of second wings extending radially from an external surface of the second body; and a first mold bottom accommodating the second mold divider therein and provided with a plurality of second locking parts for coupling to the second wings along an inner periphery thereof, and wherein said kid top comprises:

a second soft top having a plurality of openings and screw holes;

a third mold divider having a plurality of first grid panels;

a second mold top accommodating the second soft top therein and provided with a plurality of third locking parts for coupling to the first grid panels along an inner periphery thereof, and said kid bottom comprises:

a fourth mold divider formed with a plurality of second grid panels; and a second mold bottom accommodating the fourth mold divider therein and provided with a plurality of fourth locking parts for coupling to the second grid panels along an inner periphery thereof.

3. The dual golf bag as defined in claim 2, wherein each longitudinal end of said first and second wings of the first and second mold dividers of the mother bag is formed with a coupling slot, and said first and said second locking parts are provided with a locking hole and a detent for mating with the coupling slots of the first and second wings, whereas each longitudinal end of said first and second grid panels of the third and fourth mold dividers of the kid bag is formed with a coupling slot, and said third locking part at the kid top and said fourth locking part at the kid bottom are each provided with a locking hole and a detent for coupling to the coupling slots of the first and second grid panels.

4. The dual golf bag as defined in claim 2, wherein said first and second wings of said first and second mold dividers are disposed with a plurality of fabric bands therebetween, whereas said first and second grid panels of the third and fourth mold dividers are disposed with a plurality of fabric bands therebetween.

5. The dual golf bag as defined in claim 2, wherein said mother bag is formed with the first mold top and the first mold bottom, each including a plurality of rod stay tubes with a plurality of rods inserted therebetween, and said kid bag is formed with the second mold top and the second mold bottom, each including a plurality of rod stay tubes with a plurality of rods inserted therebetween.

6. The dual golf bag as defined in claim 1, wherein said mother bag and said kid bag each further comprises a separate strap attached to the respective bag.

* * * * *